US011044939B2

(12) United States Patent
Jaramillo et al.

(10) Patent No.: US 11,044,939 B2
(45) Date of Patent: Jun. 29, 2021

(54) TUBULAR ELEMENTS FOR SMOKING ARTICLES

(71) Applicant: PHILIP MORRIS PRODUCTS S.A., Neuchatel (CH)

(72) Inventors: Andres Alberto Jaramillo, Medellin (CO); Robert Emmett, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 211 days.

(21) Appl. No.: 15/738,784

(22) PCT Filed: Aug. 25, 2016

(86) PCT No.: PCT/EP2016/070061
§ 371 (c)(1),
(2) Date: Dec. 21, 2017

(87) PCT Pub. No.: WO2017/036909
PCT Pub. Date: Mar. 9, 2017

(65) Prior Publication Data

US 2018/0177225 A1 Jun. 28, 2018

(30) Foreign Application Priority Data

Aug. 28, 2015 (EP) ..... 15183031

(51) Int. Cl.
*A24D 3/02* (2006.01)
*A24C 5/46* (2006.01)
(Continued)

(52) U.S. Cl.
CPC ..... *A24D 3/0291* (2013.01); *A24C 5/46* (2013.01); *A24D 3/10* (2013.01); *A24D 3/14* (2013.01);
(Continued)

(58) Field of Classification Search
CPC ..... A24D 3/0291; A24D 3/10; A24D 3/14; A24C 5/46; B31C 3/04; Y10T 428/1352;
(Continued)

(56) References Cited

U.S. PATENT DOCUMENTS 2,393,347 A 1/1946 Stuart
2,643,988 A * 6/1953 Walter ..... C08L 27/12 524/401
(Continued)

FOREIGN PATENT DOCUMENTS

CN 202480393 10/2012
CN 102774035 11/2012
(Continued)

OTHER PUBLICATIONS

International Search Report and Written Opinion for PCT/EP2016/070061 dated Nov. 17, 2016 (9 pages).
(Continued)

*Primary Examiner* — James C Yager
(74) *Attorney, Agent, or Firm* — Mueting Raasch Group

(57) ABSTRACT

There is provided a tubular element for use in the manufacture of a filter of a smoking article, the tubular element comprising a first and a second layer wound of substantially continuous strips of a cellulose-fibre-based web material. The strips have predetermined thickness (T) and width (W). The web material is coated on a first surface with an activatable polymer and the first surface of the web material in the first layer faces the first surface of the web material in the second layer. An external diameter of the tubular element is substantially uniform over a given length.

8 Claims, 3 Drawing Sheets

(51) Int. Cl.

| | |
|---|---|
| ***A24D 3/10*** | (2006.01) |
| ***A24D 3/14*** | (2006.01) |
| *B31C 3/04* | (2006.01) |

(52) U.S. Cl.
CPC ..... *B31C 3/04* (2013.01); *Y10T 428/1303* (2015.01); *Y10T 428/139* (2015.01); *Y10T 428/1352* (2015.01); *Y10T 428/1393* (2015.01)

(58) Field of Classification Search
CPC ..... Y10T 428/1303; Y10T 428/139; Y10T 428/1393
See application file for complete search history.

(56) References Cited

U.S. PATENT DOCUMENTS

| | | | |
|---|---|---|---|
| 3,033,736 | A | 5/1962 | Aberg |
| 3,102,458 | A | 9/1963 | Schur |
| 10,357,057 | B2 | 7/2019 | Kadiric |

FOREIGN PATENT DOCUMENTS

| | | |
|---|---|---|
| CN | 102909895 | 2/2013 |
| CN | 102950817 | 3/2013 |
| CN | 104540402 | 4/2015 |
| DE | 4017746 | 12/1991 |
| EA | 8790 | 8/2007 |
| EP | 0516488 | 12/1992 |
| EP | 0615698 | 9/1994 |
| EP | 0888877 | 1/1999 |
| EP | 1459876 | 9/2004 |
| EP | 2114177 | 6/2011 |
| FR | 1301954 | 8/1962 |
| GB | 715845 | 9/1954 |
| GB | 825304 | 12/1959 |
| GB | 2159386 | 12/1985 |
| JP | S43-004837 | 3/1968 |
| JP | 2015-524274 | 8/2015 |
| KZ | 14150 | 4/2004 |
| RU | 2114538 | 7/1998 |
| RU | 18224 | 6/2001 |
| RU | 2333835 | 9/2008 |
| SU | 1392 | 9/1924 |
| WO | WO 99/01276 | 1/1999 |
| WO | WO 2005/080072 | 9/2005 |
| WO | WO 2014/023555 | 2/2014 |
| WO | WO 2014/023557 | 2/2014 |
| WO | WO 2015/007556 | 1/2015 |

OTHER PUBLICATIONS

Office Action issued in Kazakhstan for Application No. 2017/1015.1 dated Nov. 23, 2018 (8 pages). English translation included.
European Extended Search Report for Application No. 15183031.2 dated Mar. 23, 2016 (6 pages).
Office Action issued in Russia for Application No. 2017144549 dated Nov. 27, 2019 (14 pages). English translation included.
Office Action issued in China for Application No. 201680038554.8 dated Aug. 4, 2020 (29 pages). English translation included.
Office Action issued in Japan for Application No. 2017-567316 dated Oct. 22, 2020 (7 pages). English translation included.

* cited by examiner

TUBULAR ELEMENTS FOR SMOKING ARTICLES

This application is a U.S. National Stage Application of International Application No. PCT/EP2016/070061, filed Aug. 25, 2016, which was published in English on Mar. 9, 2017, as International Publication No. WO 2017/036909 A1. International Application No. PCT/EP2016/070061 claims priority to European Application No. 15183031.2 dated Aug. 28, 2015.

The present invention relates to a tubular element for use in the manufacture of smoking articles, such as a filter cigarette, and to a method of forming one such tubular element.

Filter cigarettes typically comprise a rod of tobacco cut filler surrounded by a paper wrapper and a cylindrical filter aligned in end-to-end relationship with the wrapped tobacco rod and attached thereto by tipping paper. Filters often include two or more cylindrical components attached in axial alignment.

Several filters are known that comprise a tubular element for forming a hollow segment of a filter, which may, for example, define an internal cavity of the filter for receiving a sorbent or a flavourant material. For example, one such hollow segment may be comprised between two filter segments of filtration material. Further, filters are known that include a tubular element defining a mouth end cavity of the filter.

WO 2014/023557 discloses a method of forming one such tubular element from a plurality of wound paper layers. The method comprises wrapping a plurality of substantially continuous paper strips in an overlapping manner about a cylindrical mandrel. The strips are wrapped in a parallel manner or a spiral manner so as to form a substantially continuous tube on the mandrel. The formed tube may be turned about the mandrel, for example using a rubber belt, so that the paper layers are continually drawn and wrapped around the mandrel. The formed tube can then be cut into the required lengths downstream of the mandrel. In the tubular element, adjacent paper layers are preferably adhered together by an intermediate layer of adhesive, which provides a barrier to the transfer of moisture between layers.

While it is easy to control the inner diameter of one such tubular element, because it will generally substantially match the external diameter of the cylindrical mandrel about which the paper layers are wound, it may be much more difficult to control the external diameter of the tubular element. In general, portions where paper layers overlap may have a slightly larger diameter. This is undesirable, because fluctuations in the external diameter of the tubular element may result in an irregular finish of the external surface of a filter including the tubular element. This may be perceived by the consumer as a sign of poor quality.

Further, fluctuations in the external diameter of the tubular element may cause issues when the tubular element is combined with one or more other filter components to form a filter of a smoking article. This is because a combiner machine is designed to handle and process elements having a predetermined diameter, and, while tolerances are accounted for, significant variations in the external diameter of a tubular element may cause the tubular element to become stuck or not be correctly transferred from one section of the combiner machine to another. In turn, this may impact the alignment and mutual arrangement of the various components forming a filter, the performance of which may therefore be slightly altered. Further, it may at times become necessary to stop the combiner machine, and machine downtime is thus undesirably increased.

Methods for manufacturing tubular elements by winding strips of flexible material are known from other fields. For example, several methods are known for forming cardboard core tubes of toilet paper and aluminium foil rolls, or for manufacturing disposable containers. However, the manufacture of tubular elements for use in a filter for a smoking article is inevitably complicated by the smaller width and reduced thickness of the strips of web material being handled, by the significantly smaller diameter of the tubular elements, as well as by the need to control much more finely the external diameter of tubular elements. By contrast, in the manufacture of other consumer products including one tubular elements, fluctuations in the external diameter of the tubular element are not quite as critical. This is because such tubular elements are typically intended as core supports for web material that has to be wound about the tubular elements to form a reel or bobbin, and so any irregularity in the external diameter of the tubular core does not essentially impact the overall diameter of the reel or bobbin or the visual impact thereof.

Therefore, it would be desirable to provide an improved tubular element for use in the manufacture of a filter of a smoking article and a method of forming one such tubular element. In particular, it would be desirable to provide one such method that enables a better and finer control of the external diameter of tubular elements obtained by the method, and that is fully compatible with the limitations set by the materials and sizes typically associated with the manufacture of smoking articles and related components.

According to an aspect of the present invention, there is provided a tubular element for use in the manufacture of a filter of a smoking article. The tubular element comprises a first and a second layer wound of substantially continuous strips of a cellulose-fibre-based web material, the strips having predetermined thickness (T) and width (W). The web material is coated on a first surface with an activatable polymer and the first surface of the web material in the first layer faces the first surface of the web material in the second layer. An external diameter of the tubular element is substantially uniform over a given length.

According to a further aspect of the present invention, there is provided a method of forming a tubular element for use in the manufacture of a filter of a smoking article. The method comprises providing a first and a second substantially continuous strip of a cellulose-fibre-based web material having predetermined thickness (T) and width (W), the web material being coated with an activatable polymer on a first surface. Further, the method comprises winding the first and the second strip in an overlapping manner about a cylindrical mandrel element to form a substantially continuous tube on the mandrel, such that the coated surface of the first strip faces the coated surface of the second strip. Winding the strips about the mandrel element comprises introducing the overlapping strips into a clearance between the mandrel element and a sleeve element coaxial with and surrounding the mandrel element, the sleeve element having an internal diameter (D1) corresponding substantially to the external diameter of the tubular element; and moving the overlapping strips under pressure along the mandrel element, such that the overlapping strips are forced against the sleeve element. Further, the method comprises activating the activatable polymer to form a seal between the first and the second strip of web material.

It shall be appreciated that any features described with reference to one aspect of the present invention are equally applicable to any other aspect of the invention.

In accordance with the present invention, a tubular element is formed of at least a first and a second layer of a cellulose-fibre-based web material having a predetermined thickness and cut into strips having a predetermined width. In contrast to known tubular elements for use in the manufacture of smoking articles, the web material is coated on one side with an activatable polymer. The first and the second layer are formed of wound strips of the coated web material, wherein the coated surfaces of the strips in the first and second layer face one another, such that the activatable polymer is essentially comprised between two layer of the cellulose-fibre-based web material. The external diameter of the tubular element is substantially uniform over a given length.

In practice, in methods according to the present invention, the overlapping strips of the web material with the coated sides facing one another are introduced into a clearance defined between a mandrel element and a sleeve element coaxial with and surrounding the mandrel element. The internal diameter of the sleeve element corresponds to a target external diameter of the tubular element to be formed. The overlapping strips of the web material are advanced under pressure along the mandrel element, so that they are simultaneously forced against the sleeve element. Further, the activatable adhesive polymer coating is activated to seal the overlapping strips of the web material to one another.

Thus, it is advantageously easy to control the external diameter of the tubular elements according to the present invention, since their external diameter corresponds substantially to the internal diameter of the sleeve element. Without wishing to be bound to theory, it is understood that because, in contrast to existing methods, no wet bonding agent is applied to the web material while forming the tubular element, it is easier to prevent deformation of the overlapping strips of web material, which may lead to shrinkage of the tubular element during drying or curing of the bonding agent.

At the same time, it is much less likely that the clearance between the mandrel element and the sleeve element become obstructed, for example due to accumulation of a wet bonding agent. This is because, by using a web material coated with a layer of an activatable polymer, it is easier to control the amount of activatable polymer coating applied over the surface of the web material, for example by controlling, during an application operation, the thickness of the coating layer, the density of the coating material, and so forth. Accordingly, it is much easier to supply an amount of activatable polymer that is suitable for sealing the overlapping strips and for providing adequate rigidity to the tubular element, whilst at the same time simplifying the winding operation.

Thus, quality issues potentially caused by fluctuations in the external diameter of the tubular elements, when the tubular elements are used for the manufacture of smoking articles (for example, as components of multi-segment filters), can be advantageously be prevented or at least significantly reduced.

The term "strip" is used herein to refer to a generally elongate, narrow portion of a web material having a length generally much greater than a width. The term "width" is used to refer to the measurement of the extent of a strip in a direction substantially perpendicular to a longitudinal axis of the strip.

The term "thickness" is used in the present specification to refer to the minimum distance measured between two opposite surfaces of the web material from which the strips for forming the tubular element are cut. In practice, the distance at a given location is measured along a direction locally perpendicular to the opposite surfaces of the web material. The thickness of the tubular element will correspond substantially to the sum of the thickness of the overlapping strips and the thickness of the activated adhesive between overlapping strips. Accordingly, the thickness of the tubular element may not be absolutely constant, for example along a longitudinal axis of the tubular element.

In the present specification, the term "activatable" is used to describe a polymeric material that is applied to form a coating over a surface of a substrate, such as a web material, and cured such that it is unable to stick to another non-tacky component. An activatable polymer requires the supply of energy to be brought into a tacky state for adhesion to another component.

The expression "substantially uniform" is used to describe by how much the maximum and minimum value of a parameter deviate from the mean value of the parameter. By way of example, the expression "substantially uniform" may be used to describe by how much the maximum value and minimum value of a parameter as measured over a length of a tubular element deviate from a mean value of the parameter over the same length of tubular element. In the present specification, the expression "substantially uniform" is used to mean that, over a given length of a tubular element according to the present invention, the "minimum external diameter" and the "maximum external diameter" of the tubular element deviate by less than about 10 percent, preferably by less than about 5 percent, even more preferably by less than about 1 percent, and most preferably by less than about 0.5 percent from the arithmetic mean of the external diameter calculated over the same length of tubular element.

As illustrated in FIG. 1, the external diameter is measured over a given length of the tubular element at four evenly spread points of measurements A to D. Adjacent points of measurements are spaced 15 millimeters apart along a longitudinal axis of the tubular element. At each one of the points of measurement A to D, the external diameter of the tubular element is measured at four angular positions approximately equally spaced about the external circumference of the tubular element, as described by numerals 1 to 4 in FIG. 2. The "arithmetic mean" external diameter of the tubular element is calculated based on the resulting 16 measurements. The largest external diameter measured among the 16 measurements taken is regarded as the "maximum external diameter". The smallest external diameter measured among the 16 measurements taken is regarded as the "minimum external diameter". The measurement is carried out two weeks after winding and after conditioning of the tubular element for 24 hours at 20 degrees Celsius and 60 percent relative humidity.

For example, a tubular element in accordance with the present invention may have a mean external diameter of 6.64 millimeters, with the maximum external diameter being 6.66 millimeters and the minimum external diameter being 6.62 millimeters.

In general, a tubular element according to the present invention comprises at least a first and a second layer wound of substantially continuous strips of a cellulose-fibre-based web material. The strips have predetermined thickness (T) and width (W), and the web material is coated on a first surface with an activatable polymer. The strips are wound such that the first surface of the web material in the first layer faces the first surface of the web material in the second layer. An external diameter of the tubular element is substantially uniform over a given length.

The cellulose-fibre-based web material is preferably a paper material. In some embodiments, the first and the second layer of substantially continuous strips are spirally wound. In alternative embodiments, the first and the second layer of substantially continuous strips are parallel wound.

The thickness (T) of the web material is preferably at least about 50 micrometers. More preferably, the thickness (T) of the web material is at least about 70 micrometers. In addition, or as an alternative, the thickness (T) of the web material is preferably less than about 300 micrometers. More preferably, the thickness (T) of the web material is less than about 150 micrometers. The first and the second strip may both have the same thickness or different thicknesses.

In some preferred embodiments, the thickness (T) of the web material may be from about 50 micrometers to about 300 micrometers. In some particularly preferred embodiments, the thickness (T) of the web material is about 100 micrometers.

The width (W) of the strips of web material is preferably at least about 2.5 millimeters. More preferably, the width (W) of the strips is at least 5 millimeters. Even more preferably, the width (W) of the strips is at least 7 millimeters. In addition, or as an alternative, the width (W) of the strips of web material is preferably less than about 20 millimeters. More preferably, the width (W) of the strips is less than about 15 millimeters. Even more preferably, the width (W) of the strips is less than about 10 millimeters. The first and the second strip may both have the same width or different widths.

In some preferred embodiment, the width of the strips may be from about 2.5 millimeters to about 20 millimeters. In some particularly preferred embodiment, the width of the strips may be about 8 millimeters.

FIG. 4 illustrates a strip of web material being wound into a cylindrical arrangement. The skilled person will notice that the width (W) of the strip, the external diameter (D), the pitch (P) and the helix angle ($\alpha$) of the tubular elements according to the present invention are related. An example of this geometrical correlation is shown, in more detail, in FIG. 5. In general, the width (W) of the strips, the pitch (P) and the helix angle ($\alpha$) are chosen as a function of a target external diameter (D) of the tubular elements. Without wishing to be bound to theory, it is understood that larger helix angles ($\alpha$) will provide a more consistent and less sensitive process.

Preferably, in tubular elements according to the present invention the helix angle ($\alpha$) is at least about 40 degrees. More preferably, the helix angle ($\alpha$) is at least about 44 degrees. Even more preferably, the helix angle ($\alpha$) is at least about 48 degrees. In addition, or as an alternative, in tubular elements according to the present invention the helix angle ($\alpha$) is preferably less than about 60 degrees. More preferably, the helix angle ($\alpha$) is less than about 56 degrees. Even more preferably, the helix angle ($\alpha$) is less than about 52 degrees.

In some preferred embodiments, helix angle ($\alpha$) is from about 40 degrees to about 60 degrees. In some particularly preferred embodiments, the helix angle ($\alpha$) is about 50 degrees.

The activatable polymer is preferably a heat-activatable polymer. More preferably, the activatable polymer is a thermoplastic selected from the group consisting of polyethylene (PE), low density polyethylene (LDPE), polyethylene terephthalate (PET).

A temperature of activation of the activatable polymer is preferably at least about 50 degrees Celsius, more preferably at least about 80 degrees Celsius, even more preferably at least about 100 degrees Celsius. In addition, or as an alternative, a temperature of activation of the activatable polymer is preferably less than about 200 degrees Celsius, more preferably at less than about 150 degrees Celsius, even more preferably less than about 120 degrees Celsius. In some preferred embodiments, a temperature of activation of the activatable polymer is from about 50 degrees Celsius to about 200 degrees Celsius. In some particularly preferred embodiment, a temperature of activation of the activatable polymer is from about 100 degrees Celsius to about 120 degrees Celsius.

Tubular elements in accordance with the present invention may be formed by winding a first and a second substantially continuous strip of a cellulose-fibre-based web material having predetermined thickness (T) and width (W), the web material being coated with an activatable polymer on a first surface, about a cylindrical mandrel element to form a substantially continuous tube on the mandrel, such that the coated surface of the first strip faces the coated surface of the second strip.

In methods according to the present invention, winding the strips about the mandrel element comprises introducing the overlapping strips into a clearance between the mandrel element and a sleeve element coaxial with and surrounding the mandrel element, the sleeve element having an internal diameter (D) corresponding substantially to the external diameter of the tubular element; and moving the overlapping strips under pressure along the mandrel element, such that the overlapping strips are forced against the sleeve element.

Further, in methods according to the present invention, the activatable polymer is activated to form a seal between the first and the second strip of web material.

Preferably, the activatable polymer is a heat-activatable polymer, and activating the activatable polymer comprises supplying heat to the overlapping strips as they are advanced along the mandrel element. As an alternative, the method may further comprise providing an ultrasonic vibrating die as the sleeve element, and activating the activatable polymer comprises powering the ultrasonic vibrating die.

In some embodiments, the method comprises comprising winding at least one further strip of cellulose-fibre-based web material coated on a first surface with an activatable polymer in an about the cylindrical mandrel element and the first and the second strips to form a substantially continuous tube on the mandrel. In more detail, the at least one further strip is wound about the first and second strips with the coated first surface facing the non-coated second surface of the second strip. This is advantageous, in that layers of web material and layers of adhesive polymer thus advantageously alternate in the tubular element along a radial direction thereof. At the same time, the non-coated surface of a strip of web material faces the mandrel element. Accordingly, the likelihood that the substantially continuous tube being formed may be stuck to the mandrel element when the activatable polymer is activated is advantageously minimised.

Preferably, the method further comprises turning the substantially continuous tube being formed around the mandrel, so that the strips of pre-coated web material are continually drawn and wrapped around the mandrel.

Further, the method preferably comprises cutting the substantially continuous tubular element into tubular segments having a predetermined length (L) by cutting through the substantially continuous tubular element at a location downstream of the mandrel element.

The invention will be further described, by way of example only, with reference to the drawings of the accompanying Figures, wherein.

Figure 1:
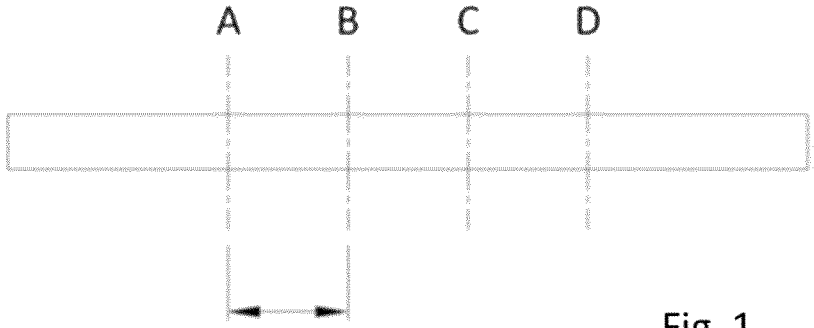
FIG. 1 illustrates a schematic side view of a tubular element according to the present invention.
Figure 2:
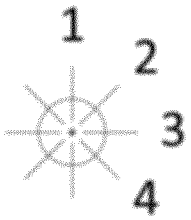
FIG. 2 shows a schematic transverse cross section of the tubular element of FIG. 1.
Figure 3:
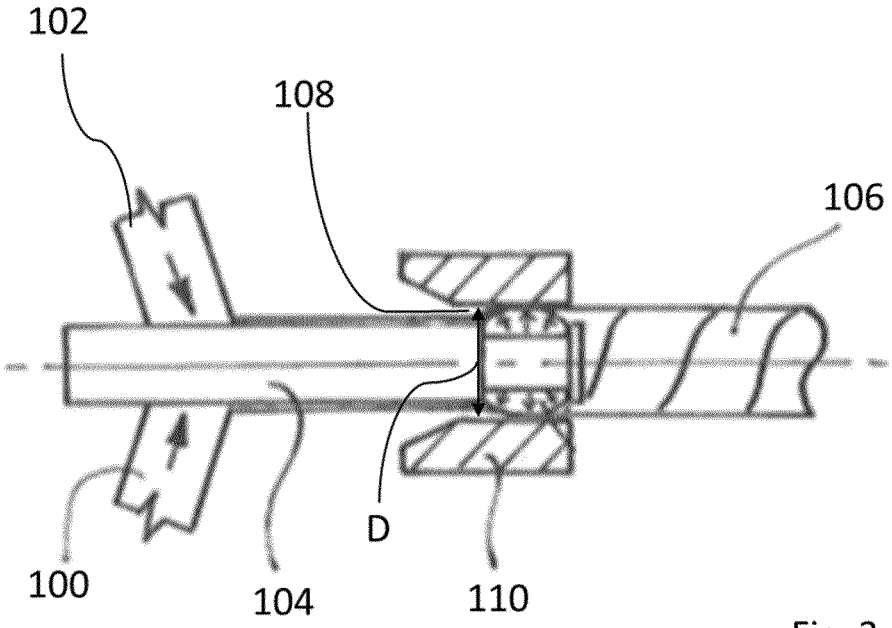
Figure 4:
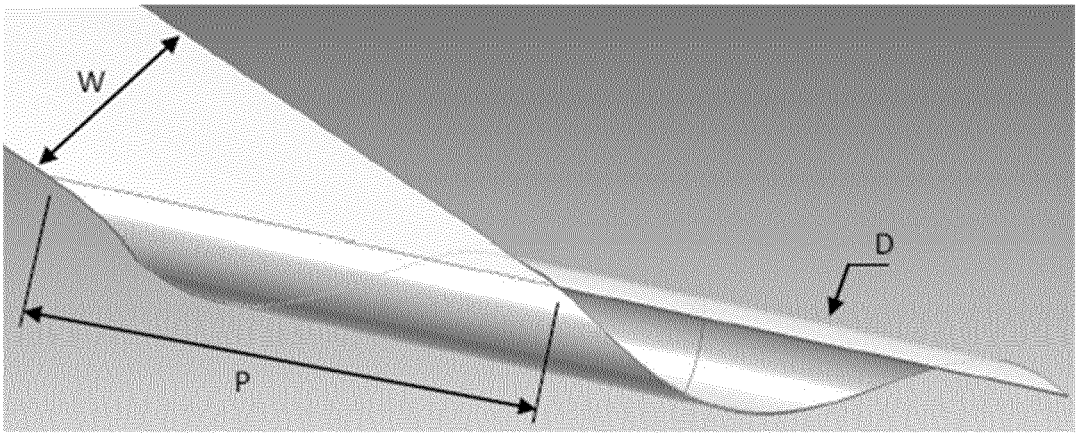
Figure 5:
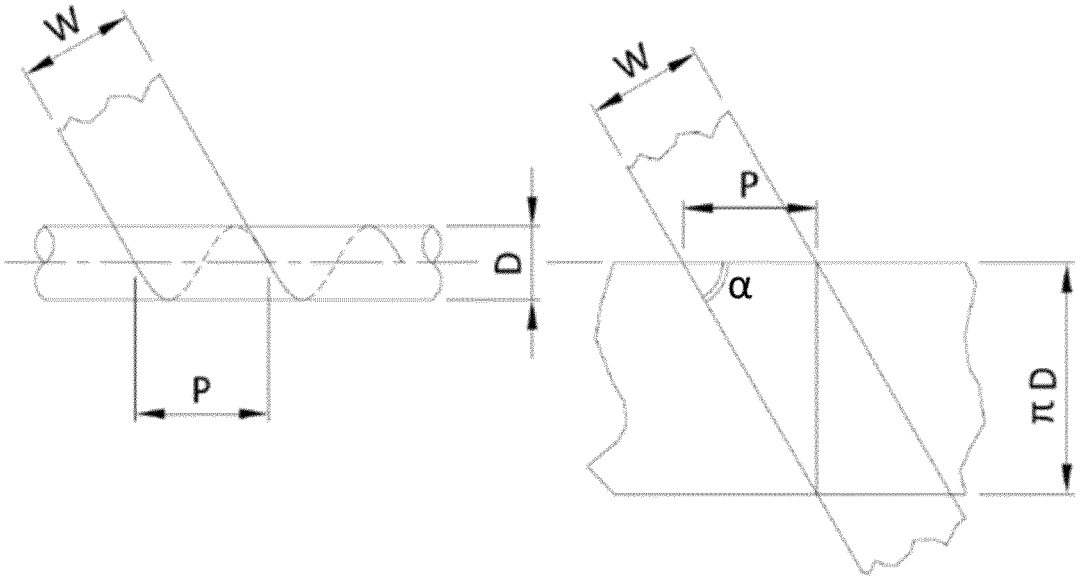
Figure 6:
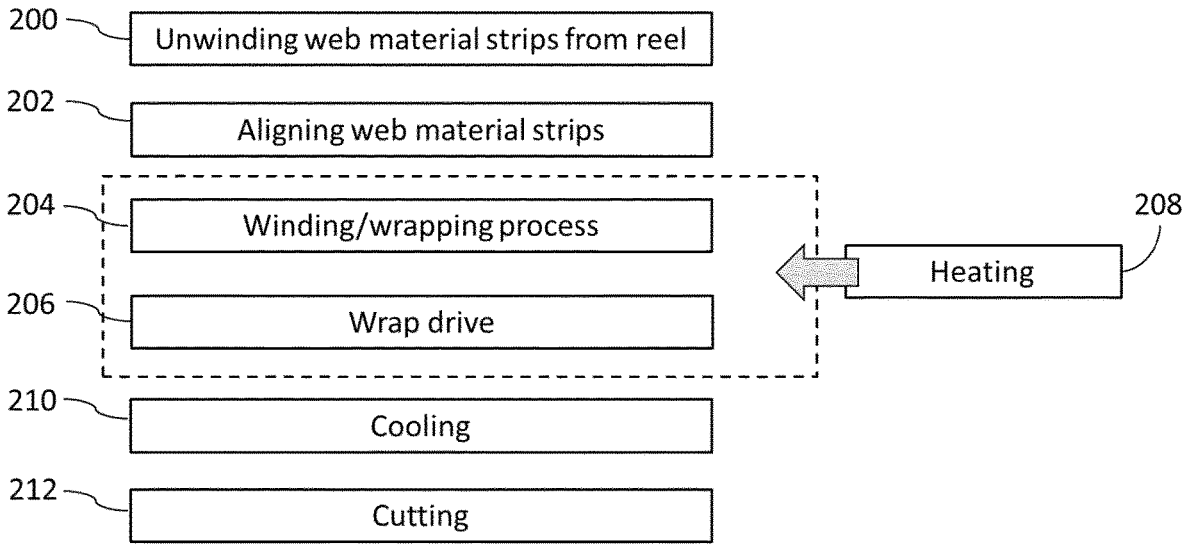

FIG. 3 schematically shows a method of forming a tubular element for use in the manufacture of a filter of a smoking article in accordance with the present invention;

FIG. 4 is a schematic perspective view of a length of a strip of web material for forming a tubular element in accordance with the present invention being wound into a cylindrical arrangement;

FIG. 5 is another side view of a tubular element in accordance with the present invention; and FIG. 6 is a flow-chart illustrating the steps of a method of forming a tubular element for use in the manufacture of a filter of a smoking article in accordance with the present invention.

A first and a second substantially continuous strips 100, 102 of a cellulose-fibre-based web material (for example, paper) having a thickness (T) of about 200 micrometers and a width (W) of about 5 millimeters are shown in FIG. 3. The strips 100, 102 are coated on a first surface with a thin layer of polyethylene. The polyethylene coating the strips 100, 102 is cured, such that it does not stick to a non-tacky substrate and is heat-activatable.

As illustrated in FIG. 3, the strips 100, 102 are wound in an overlapping manner about a cylindrical mandrel element 104 to form a substantially continuous tube 106 on the mandrel. The LDPE-coated surface of the first strip 100 faces the LDPE-coated surface of the second strip 102. As they are wound about the mandrel element 104, the overlapping strips 100, 102 are introduced into a clearance 108 defined between the mandrel element 104 and a sleeve element 110 coaxial with and surrounding the mandrel element 104. The sleeve element 110 has an internal diameter D of about 8 millimeters. The overlapping strips 100, 102 are moved under pressure along the mandrel element 104, such that the strips 100, 102 are forced against the sleeve element 110. This may be achieved by supplying a flow of pressurised air from the surface of the mandrel element 104 into the tubular element being formed, so as to broaden the gap between the mandrel element 104 and the overlapping strips 100, 102 of web material. This is illustrated in FIG. 3 by means of arrow directed substantially radially.

Simultaneously, the LDPE coating the strips 100, 102 is activated by supplying heat at the sleeve element 110, so as to form a seal between the first and the second strip 100, 102 of web material. The substantially continuous tube 106 may be cut into tubular segments at a location downstream of the sleeve element 110.

In a typical process, as illustrated by the flow-chart of FIG. 6, the method may further include a step 200 of unwinding the strips from respective reels and a step 202 of aligning the strips in preparation for the winding/wrapping process 204 described above. The winding/wrapping process 204 and the step 206 of advancing the tubular element being formed along the mandrel element are carried out while heat is supplied (step 208) to the activatable adhesive. This is followed by a step 210 of cooling and by a step 212 of cutting the continuous tubular element formed into tubular segments having a predetermined length.

Table 1 below lists some preferred combinations of width (W) of the strips, external diameter (D), pitch (P) and helix angle ($\alpha$) for tubular elements of the present invention

| | | | |
|---|---|---|---|
| Average external diameter of tubular element [mm] | 7.45 | 7.00 | 5.16 |
| Width of second strip [mm] | 15.0 | 15.0 | 10.0 |
| Width of first strip [mm] | 14.75 | 14.69 | 9.76 |
| Helix Angle [degrees] | 46.1 | 42.1 | 46.2 |

COMPARATIVE EXAMPLE

A tubular element (Example A) was manufactured as described above from strips of a cellulose-fibre-based web coated with polyethylene as the activatable polymer.

The external diameter of the tubular element was measured according to the procedure set out above with a laser micrometer LS-7030M supplied by Keyence. The micrometer has a measuring range of 0.3 to 30 millimeters, with an accuracy of +/−2 micrometers.

Commercially available tubular elements (Examples B1 and B2) from two independent sources were also tested. Examples B1 and B2 were manufactured using the cellulose-fibre-based web and poly(vinyl acetate) as a wet glue.

The results of the measurements of the external diameter of the tubular elements can be found in the following Table 2.

| Sample | Arithmetic mean external diameter [millimetres] | Maximum external diameter [millimetres] | Minimum external diameter [millimetres] | Deviation (+/−) |
|---|---|---|---|---|
| A | 6.640 | 6.663 | 6.615 | 0.024 |
| B1 | 7.472 | 7.512 | 7.415 | 0.048 |
| B2 | 7.480 | 7.640 | 7.456 | 0.092 |

The invention claimed is:

1. A tubular element for use in the manufacture of a filter of a smoking article, the tubular element comprising a first and a second layer wound of substantially continuous strips of a cellulose-fibre-based web material, the strips having predetermined thickness (T) and width (W), the width of the strips being from about 2.5 millimetres to about 20 millimetres, wherein the cellulose-fibre-based web material in the first layer has a first surface and a second surface opposite the first surface, wherein the cellulose-fibre-based web material in the second layer has a first surface and a second surface opposite the first surface; wherein the cellulose-fibre-based web material in the first layer is coated on the first surface with an activatable polymer and the first surface of the cellulose-fibre-based web material in the first layer faces the first surface of the cellulose-fibre-based web material in the second layer, wherein a temperature of activation of the activatable polymer is from about 50 degrees Celsius to about 150 degrees Celsius, wherein a helix angle ($\alpha$ ) of the tubular element is from about 40 degrees to about 60 degrees and wherein a minimum external diameter of the tubular element and a maximum external diameter of the tubular element deviate over a given length of tubular element by less than about 10 percent from the arithmetic mean of the external diameter calculated over said given length of tubular element.

2. A tubular element according to claim 1, wherein the thickness (T) of the web material is at least about 50 micrometres.

3. A tubular element according to claim 1, wherein the thickness (T) of the web material is less than about 300 micrometres.

4. A tubular element according to claim 1, wherein the external diameter of the tubular element is less than about 8 millimetres.

5. A tubular element according to claim 1, wherein the activatable polymer is a heat-activatable polymer.

6. A tubular element according to claim 1, wherein the activatable polymer is a thermoplastic selected from the group consisting of polyethylene (PE), low density polyethylene (LDPE), polyethylene terephthalate (PET).

7. A tubular element according to claim 1, wherein the internal diameter (D) of the sleeve element is less than about 8 mm.

8. A tubular element according to claim 1, wherein the internal diameter (D) of the sleeve element is at least about 4 mm.

* * * * *